United States Patent [19]

Ueda et al.

[11] Patent Number: 4,939,116

[45] Date of Patent: Jul. 3, 1990

[54] THERMOSENSITIVE RECORDING MATERIAL

[75] Inventors: Takashi Ueda; Keiichi Maruta; Hiroshi Yaguchi, all of Numazu, Japan

[73] Assignee: Ricoh Company, Ltd., Tokyo, Japan

[21] Appl. No.: 349,649

[22] Filed: May 10, 1989

Related U.S. Application Data

[63] Continuation-in-part of Ser. No. 63,869, Jun. 19, 1987, Pat. No. 4,857,502.

[30] Foreign Application Priority Data

Jun. 19, 1986 [JP] Japan ..... 61-143946
Sep. 10, 1986 [JP] Japan ..... 61-213593

[51] Int. Cl.[5] ..... B41M 5/18

[52] U.S. Cl. ..... 503/204; 427/150; 427/151; 427/152; 503/216; 503/217; 503/218; 503/221

[58] Field of Search ..... 427/150–152; 503/204, 216–218, 221, 225, 226

[56] References Cited

U.S. PATENT DOCUMENTS 4,542,395 9/1985 Saito et al. ..... 503/216

FOREIGN PATENT DOCUMENTS 0230890 11/1985 Japan ..... 503/218
0231766 11/1985 Japan ..... 503/218

*Primary Examiner*—Bruce H. Hess
*Attorney, Agent, or Firm*—Oblon, Spivak, McClelland, Maier & Neustadt

[57] ABSTRACT

A thermosensitive recording material is disclosed, which comprises (a) a support material; (b) a first thermosensitive coloring layer which comprises a first colorless or light-colored leuco dye having formula (I), (I)

and a first color developer having formula (II) capable of inducing color formation in said first leuco dye upon application of heat thereto;

(II)

(c) a second thermosensitive coloring layer which comprises at least a second leuco dye having formula (III), (III)

the first and second thermosensitive coloring layers being formed on the support.

4 Claims, No Drawings

THERMOSENSITIVE RECORDING MATERIAL

BACKGROUND OF THE INVENTION

The present invention relates to an improved thermosensitive recording material comprising a support on which (i) a first thermosensitive coloring layer comprising a first colorless or light-colored leuco dye and a first color developer capable of inducing color formation in the first leuco dye upon application of heat thereto, and (ii) a second colorless or light-colored leuco dye and a color developer capable of inducing color formation in the second leuco dye upon application of heat thereto are overlaid in any order.

Recording materials using leuco dyes are conventionally known and used in practice, for example, as pressuresensitive recording sheets and thermosensitive recording sheets. A conventional thermosensitive recording material using such leuco dye is composed of a support and a thermosensitive coloring layer comprising a leuco dye and a color developer formed thereon. Colored images are formed on the thermosensitive coloring layer upon image-wise application of heat through a thermal resistor element to which image signals are applied.

Such thermosensitive recording materials are employed in a variety of fields, for instance, for use with printers of computers, recorders of medical analytical instruments, facsimile apparatus, automatic ticket vending apparatus, and thermosensitive copying apparatus, since they have such advantages over other conventional recording materials that (1) images can be formed by simple heat application, without complicated steps for development and image fixing, and therefore image recording can be speedily performed by a simple recording apparatus, without generation of noise and causing environmental pollution, and that (2) the thermosensitive recording materials are inexpensive.

In such conventional thermosensitive recording materials, there is usually employed in the thermosensitive coloring layer a thermal coloring system comprising a combination of (i) a colorless or light-colored leuco dye such as crystal violet lactone and leuco crystal violet which are colored in blue, and 7-anilino-substituted fluoran compounds which are colored in black, and (ii) a color developer which induces such color formation in the leuco dyes upon application of heat thereto.

In accordance with the recent development of optical character reading apparatus and bar-code reading apparatus, thermosensitive recording materials suitable for use in such reading apparatus are desired. In such reading apparatus, however, such a light source as emits light having a wavelength of 700 nm or more is in general use. However, the above-mentioned leuco dyes, when colored in blue or black, scarcely absorb light in a near infrared region, specifically light having a wavelength of 700 nm or more. Therefore, it is impossible for the above reading apparatus to read the characters or bar codes developed by the above leuco dyes.

Under such circumstances, there is a great demand for novel leuco dyes which absorb light having a wavelength of 700 nm or more when colored by a color developer.

SUMMARY OF THE INVENTION

It is therefore an object of the present invention to provide a thermosensitive recording material capable of forming colored images upon image-wise application of heat, which colored images can be read, for instance, by an optical character reading apparatus and a bar-code reading apparatus employing a semi-conductor laser.

Another object of the present invention is to provide a thermosensitive recording material capable of forming colored images which hardly fade with time and are free from fogging.

According to the present invention, the above objects of the present invention can be attained by a thermosensitive recording material comprising:

(i) a support material, (ii) a first thermosensitive coloring layer formed thereon, which comprises at least a first leuco dye having formula (I),

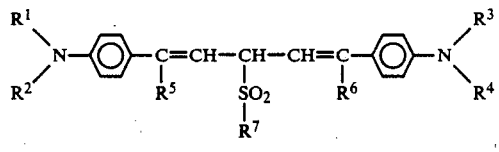

(I)

wherein $R^1$, $R^2$, $R^3$ and $R^4$ each represent hydrogen or an alkyl group having a substituent, $R^5$ and $R^6$ each represent hydrogen or a phenyl group which may have a substituent, and $R^7$ represents an alkyl group which may have a substituent or a phenyl group which may have a substituent, and a first color developer having formula (II) capable inducing color formation in the first leuco dye upon application of heat thereto,

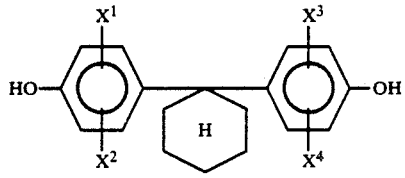

(II)

wherein $X^1$, $X^2$, $X^3$ and $X^4$ each represent hydrogen or an alkyl group having 1 to 4 carbon atoms, and (iii) a second thermosensitive coloring layer which comprises at least a second leuco dye having formula (III),

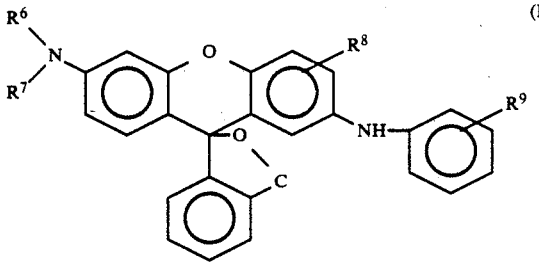

(III)

wherein $R^6$ and $R^7$ each represent a saturated or unsaturated hydrocarbon group having 1 to 10 carbon atoms, which may be in a cyclic or noncyclic form and may include an ether bond therein, $R^8$ represents a hydrocarbon group having 1 to 2 carbon atoms, or halogen, and $R^9$ represents hydrogen, halogen, or a hydrocarbon group having 1 to 6 carbon atoms, and a second color developer capable inducing color formation in the second leuco dye upon application of heat thereto.

DETAILED DESCRIPTION OF THE PREFERRED EMBODIMENTS

In the present invention, the first thermosensitive coloring layer and the second thermosensitive coloring layer can be overlaid on the support in any order, but it is preferable to successively form the first thermosensitive coloring layer and the second thermosensitive coloring layer on the support.

The first leuco dyes having formula (I) can be prepared by reducing the carbonyl group of bis(p-di-substituted aminobenzal)acetone by a carbonyl reducing agent such as lithium aluminum hydride and by adding an acid such as perchloric acid thereto to form bis(p-disubstituted aminostyryl)carbenium salt, followed by causing the salt to react this salt with sodium sulfinate.

Specific examples of the first leuco dye having formula (I) for use in the present invention are as follows:

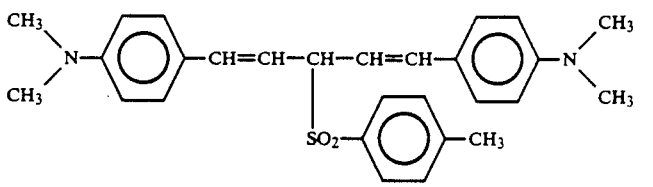

(1)

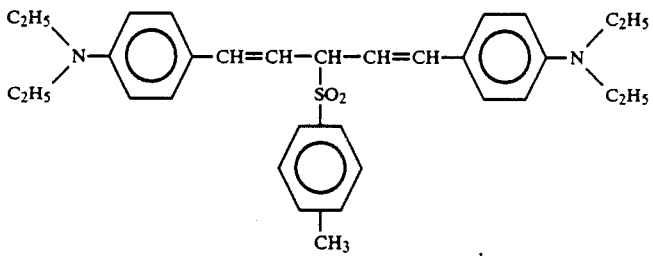

(2)

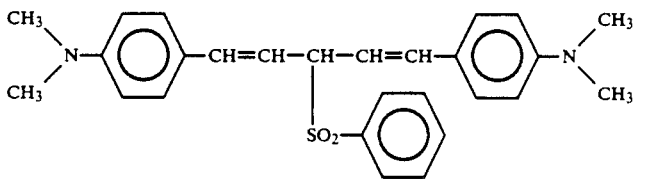

(3)

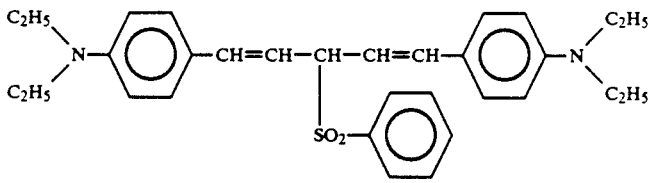

(4)

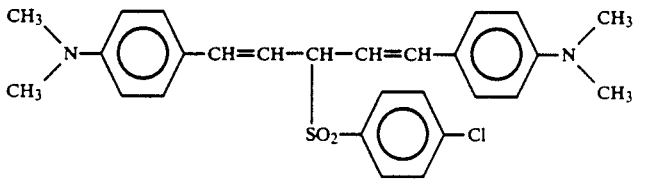

(5)

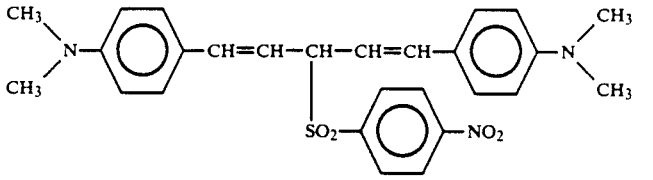

(6)

-continued
(7)
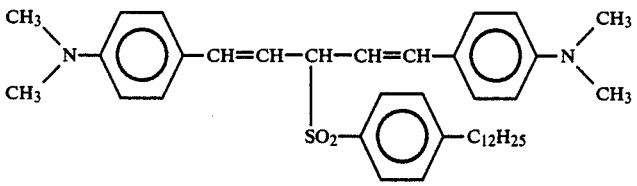
(8)
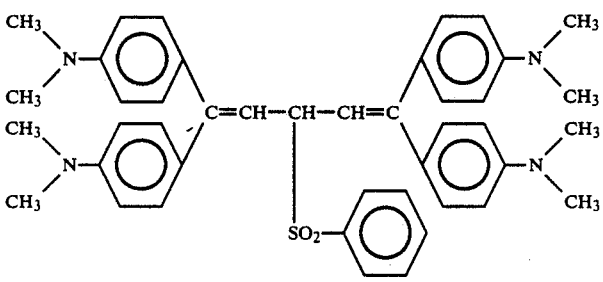
(9)
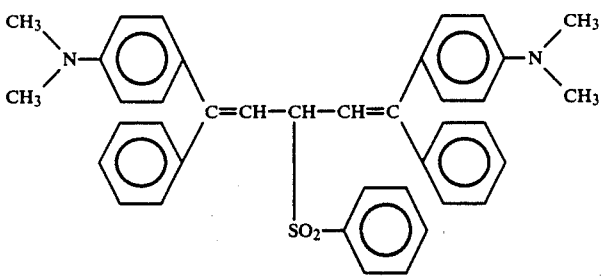
(10)
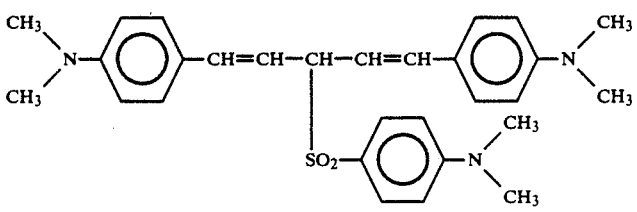
(11)
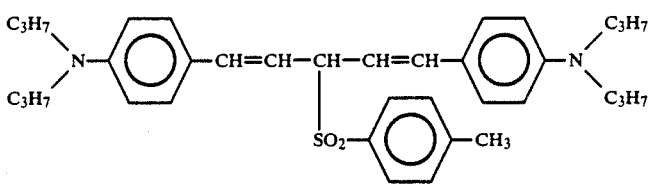
(12)
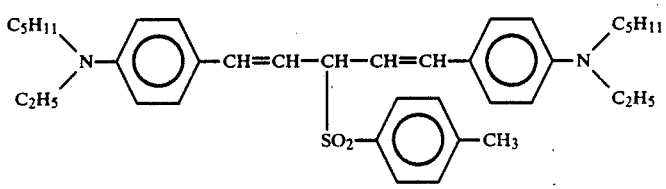
Specific examples of the first color developer having the above-mentioned formula (II) are as follows:
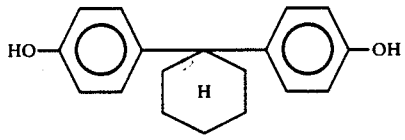
-continued
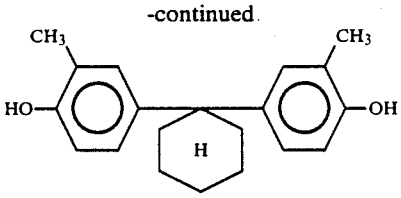

-continued

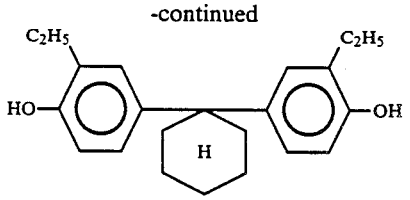

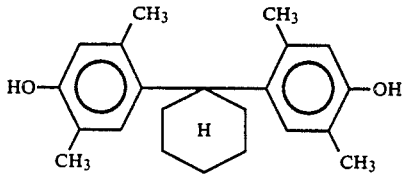

Specific examples of the second leuco dye having formula (III), which are fluoran compounds, for use in the present invention are as follows:

3-(N-p-tolyl-N-ethylamino)-6-methyl-7-anilinofluoran,
3-diethylamino-6-methyl-7-(m-trichloromethylanilino) fluoran,
3-diethylamino-7-(o-chloroanilino)fluoran,
3-dibutylamino-7-(o-chloroanilino)fluoran,
3-N-methyl-N-acylamino-6-methyl-7-anilinofluoran,
3-(N-methyl-N-cyclohexyl)amino-6-methyl-7-anilinofluoran, and
3-diethylamino-6-methyl-7-anilinofluoran.

In the present invention, any conventional leuco dyes for use in conventional thermosensitive recording materials can be employed in combination with the leuco dyes having the previously mentioned formula (I).

Examples of such conventional leuco dyes are triphenylmethane-type leuco compounds, fluoran-type leuco compounds, phenothiazine-type leuco compounds, auramine-type leuco compounds, spiropyran-type leuco compounds and indolinophthalide-type leuco compounds are preferably employed.

Specific examples of those leuco dyes are as follows:

3,3-bis(p-dimethylaminophenyl)-phthalide,
3,3-bis(p-dimethylaminophenyl)-6-dimethylaminophthalide (or Crystal Violet Lactone),
3,3-bis(p-dimethylaminophenyl)-6-diethylaminophthalide,
3,3-bis(p-dimethylaminophenyl)-6-chlorophthalide,
3,3-bis(p-dibutylaminophenyl)-phthalide,
3-cyclohexylamino-6-chlorofluoran,
3-dimethylamino-5,7-dimethylfluoran,
3-diethylamino-7-chlorofluoran,
3-diethylamino-7-methylfluoran,
3-diethylamino-7,8-benzfluoran,
3-diethylamino-6-methyl-7-chlorofluoran, 3-(N-p-tolyl-N-ethylamino)-6-methyl-7-anilinofluoran,
3-pyrrolidino-6-methyl-7-anilinofluoran,
2-[N-(3'-trifluoromethylphenyl)amino]-6-diethylaminofluoran,
2-[3,6-bis(diethylamino)-9-(o-chloroanilino)xanthylbenzoic acid lactam],
3-diethylamino-6-methyl-7-(m-trichloromethylanilino)-fluoran,
3-diethylamino-7-(o-chloroanilino)fluoran,
3-dibutylamino-7-(o-chloroanilino)fluoran,
3-N-methyl-N-amylamino-6-methyl-7-anilinofluoran,
3-N-methyl-N-cyclohexylamino-6-methyl-7-anilinofluoran,
3-diethylamino-6-methyl-7-anilinofluoran,
3-(N,N-diethylamino)-5-methyl-7-(N,N-dibenzylamino) fluoran,
benzoyl leuco methylene blue,
6'-chloro-8'-methoxy-benzoindolino-spiropyran,
6'-bromo-3'-methoxy-benzoindolino-spiropyran,
3-(2'-hydroxy-4'-dimethylaminophenyl)-3-(2'-methoxy-5'-chlorophenyl)phthalide,
3-(2'-hydroxy-4'-dimethylaminophenyl)-3-(2'-methoxy-5'-nitrophenyl)phthalide,
3-(2'-hydroxy-4'-diethylaminophenyl)-3-(2'-methoxy-5'-methylphenyl)phthalide,
3-(2'-methoxy-4'-dimethylaminophenyl)-3-(2'-hydroxy-4'-chloro-5'-methylphenyl)phthalide,
3-morpholino-7-(N-propyl-trifluoromethylanilino)fluoran,
3-pyrrolidino-7-trifluoromethylanilinofluoran,
3-diethylamino-5-chloro-7-(N-benzyl-trifluoromethylanilino)fluoran,
3-pyrrolidino-7-(di-p-chlorophenyl)methylaminofluoran,
3-diethylamino-5-chloro-7-(α-phenylethylamino)fluoran,
3-(N-ethyl-p-toluidino)-7-(α-phenylethylamino)fluoran,
3-diethylamino-7-(o-methoxycarbonylphenylamino)-fluoran,
3-diethylamino-5-methyl-7-(α-phenylethylamino)fluoran,
3-diethylamino-7-piperidinofluoran,
2-chloro-3-(N-methyltoluidino)-7-(p-n-butylanilino)-fluoran,
3-(N-benzyl-N-cyclohexylamino)-5,6-benzo-7-naphthylamino-4'-bromofluoran, and
3-diethylamino-6-methyl-7-mesidino-4',5'-benzofluoran.

In the present invention, the following color developers can also be employed in combination with the previously mentioned preferable color developers of formula (III): a variety of electron acceptors can be employed, such as phenolic materials, thiophenol compounds, thiourea derivatives, organic acids and metal salts thereof.

Specific examples of such electron acceptors are bentonite, zeolite, acidic terra abla, active terra abla, colloidal silica, aluminum chloride, salicylic acid, 3-tert-butylsalicylic acid, 3,5-di-tert-butylsalicylic acid, di-m-chlorophenyl thiourea, di-m-trifluoromethylphenyl thiourea, diphenylthiourea, salicylanilide, 4,4'-isopropylidenediphenol, 4,4'-isopropylidenebis(2-chlorophenol), 4,4'-isopropylidenebis(2,6-dibromophenol), 4,4'-isopropylidenebis(2,6-dichlorophenol), 4,4'-isopropylidenebis(2-methylphenol), 4,4'-isopropylidenebis(2,6-dimethylphenol), 4,4'-isopropylidenebis(2-tert-butylphenol), 4,4'-sec-butylidenediphenol, 4,4'-cyclohexylidenebisphenol, 4,4'-cyclohexylidenebis(2-methylphenol), 4-tert-butylphenol, 4-phenylphenol, 4-hydroxydiphenoxide, α-naphthol, β-naphthol, 3,5-xylenol, thymol, methyl-4-hydroxybenzoate, 4-hydroxyacetophenone, novolak-type phenolic resin, 2,2'-thiobis(4,6-dichlorophenol), catechol, resorcinol, hydroquinone, pyrogallol, phloroglucine, phloroglucinocarboxylic acid, 4-tert-octylcatechol, 2,2'-methylenebis(4-chlorophenol), 2,2'-methylenebis(4-methyl-6-tert-butylphenol), 2,2'-dihydroxy-diphenyl, ethyl p-hydroxybenzoate, propyl p-hydroxybenzoate, butyl p-hydroxybenzoate, benzyl p-hydroxybenzoate, p-chlorobenzyl p-hydroxybenzoate, o-chlorobenzyl p-hydroxybenzoate, p-methylbenzyl p-hydroxybenzoate, n-octyl benzoic acid p-hydroxybenzoate, benzoic acid, 1-hydroxy-2-naphthoic acid, 2-hydroxy-6-naphthoic acid, 4-hydroxydiphenylsulfone, bis(4-hydroxy-3-t-butylphenyl)sulfone, 4-hydroxy-4'-chlorodiphenyl sulfone, bis(4-hydroxyphenyl)sulfide, 2-hydroxy-p-toluic acid, tartaric acid, oxalic acid, maleic acid, citric acid, succinic acid, stearic acid, 4-hydroxyphthalic acid, boric acid, biimidazole, hexaphenyl biimidazole, and carbon tetrabromide.

In the present invention, a variety of conventional binder agents can be employed for binding the above mentioned leuco dyes and color developers in the thermosensitive coloring layer to the support material.

Specific examples of such binder agents are as follows: polyvinyl alcohol; starch and starch derivatives; cellulose derivatives such as methoxycellulose, hydroxyethylcellulose, carboxymethylcellulose, methylcellulose and ethylcellulose; water-soluble polymeric materials such as sodium polyacrylate, polyvinylpyrrolidone, acrylamide/acrylic acid ester copolymer, acrylamide/acrylic acid ester/methacrylic acid copolymer, styrene/maleic anhydride copolymer alkali salt, isobutylene/maleic anhydride copolymer alkali salt, polyacrylamide, sodium alginate, gelatin and casein; and latexes of polyvinyl acetate, polyurethane, styrene/butadiene copolymer, polyacrylic acid, polyacrylic acid ester, vinyl chloride/vinyl acetate copolymer, polybutylmethacrylate, ethylene/vinyl acetate copolymer and styrene/butadiene/acrylic acid derivative copolymer.

Further in the present invention, auxiliary additive components which are employed in the conventional thermosensitive recording materials, such as a filler, a surface active agent and a thermofusible material (or unguent), can be employed.

Specific examples of a filler for use in the present invention are finely-divided inorganic powders of calcium carbonate, silica, titanium oxide, aluminum hydroxide, barium sulfate, clay, talc, surface-treated calcium and surface-treated silica, and finely-divided organic powders of urea - formaldehyde resin, styrene/-methacrylic acid copolymer, and polystyrene.

As the thermofusible materials, for example, higher fatty acids, esters, amides and metallic salts thereof, waxes, dimethylterephthalate, condensation products of aromatic carboxylic acids and amines, benzoic acid phenyl esters, higher straight chain glycols, 3,4-epoxydialkyl hexahydrophthalate, higher ketones and other thermofusible organic compounds can be employed.

When necessary, an undercoat layer comprising a filler and a water-soluble binder agent may be interposed between the support and the thermosensitive coloring layer.

Further, when the thermosensitive recording material according to the present invention is employed as thermosensitive recording label sheet, an adhesive layer is formed on the back side of the support opposite the thermosensitive layer and a disposable backing sheet is further applied to the adhesive layer, which is removed prior to its use. In this case, a protective layer comprising a water-soluble resin may be formed on the thermosensitive coloring layer to increase the stability of the images formed thereon.

With reference to the following examples, the present invention will now be explained in detail.

EXAMPLE 1

Liquid A and Liquid C were prepared by dispsersing the respective components in a sand grinder for 4 hours.

| | Parts by Weight |
|---|---|
| [Liquid A] | |
| Bis(p-dimethylaminostyryl)-p-methylphenylsulfonylmethane | 10 |
| 10% aqueous solution of polyvinyl alcohol | 10 |
| Water | 30 |
| [Liquid C] | |
| 1,1-bis(4-hydroxyphenyl)cyclohexane | 10 |
| Calcium carbonate | 10 |
| 10% aqueous solution of polyvinyl alcohol | 20 |
| Water | 60 |

Liquid A and Liquid C were mixed and dispersed with a ratio by weight of 1:6, so that a first thermosensitive coloring layer coating liquid, Liquid E, was prepared.

Liquid B and Liquid D were prepared by dispersing the respective components in a sand grinder for 4 hours.

| | Parts by Weight |
|---|---|
| [Liquid B] | |
| 3-(N-methyl-N-cylohexyl)amino-6-methyl-7-anilinofluoran | 10 |
| 10% aqueous solution of polyvinyl alcohol | 10 |
| Water | 30 |
| [Liquid D] | |
| 1,7-di(4-hydroxyphenylthio)-3,5-dioxahepthane | 10 |
| Calcium carbonate | 10 |
| 10% aqueous solution of polyvinyl alcohol | 20 |
| Water | 60 |

Liquid B and Liquid D were mixed and dispersed with a ratio by weight of 1:3, so that a second thermosensitive coloring layer coating liquid, Liquid F, was prepared.

Liquid E was coated on a sheet of high quality paper having a basis weight of 52 g/cm$^2$, with a deposition of 2.5 to 5.0 g/m$^2$ when dried, whereby a first thermosensitive coloring layer was formed on the high quality paper. After drying the first thermosensitive coloring layer, Liquid F was coated on the first thermosensitive coloring layer with a deposition of 1.5 to 2.5 g/m$^2$ when dried, so that a second thermosensitive coloring layer was formed on the first thermosensitive coloring layer. The second thermosensitive coloring layer was subjected to calendering until the smoothness became 500 to 3000 seconds in terms of Bekk's smoothness, whereby a thermosensitive recording material No. 1 according to the present invention was prepared.

Comparative Example 1

Example 1 was repeated except that Liquid C employed in Example 1 was replaced by Liquid CC in which the 1,1-bis(4-hydroxyphenyl)cyclohexane in Liquid C was replaced by BPA (Bisphenol A), whereby a comparative thermosensitive recording material No. 1 was prepared.

Comparative Example 2

Example 1 was repeated except that only the first thermosensitive coloring layer coating liquid, Liquid E, was coated on a sheet of high quality paper having a basis weight of 52 g/cm$^2$, with a deposition of 2.5 to 5.0 g/m$^2$ when dried, to form a first thermosensitive coloring layer was formed on the high quality paper, without forming a second thermosensitive coloring layer, and after the first thermosensitive coloring layer was dried, it was subjected to calendering until the smoothness became 500 to 3000 seconds in terms of Bekk's smoothness, whereby a comparative thermosensitive recording material No. 2 was prepared.

Comparative Example 3

Liquid A and Liquid CC were prepared by dispsersing the respective components in a sand grinder for 4 hours.

| | Parts by Weight |
|---|---|
| [Liquid A] | |
| Bis(p-dimethylaminostyryl)-p-methylphenylsulfonylmethane | 10 |
| 10% aqueous solution of polyvinyl alcohol | 10 |
| Water | 30 |
| [Liquid CC] | |
| BPA(Bisphenol A) | 10 |
| Calcium carbonate | 10 |
| 10% aqueous solution of polyvinyl alcohol | 20 |
| Water | 60 |

Liquid A and Liquid CC were mixed and dispersed with a ratio by weight of 1:6, so that a comparative first thermosensitive coloring layer coating liquid, Liquid CE, was prepared.

Comparative Example 2 was repeated except that the first thermosensitive coloring layer coating liquid, Liquid E, employed in Comparative Example 2 was replaced by the above prepared comparative first thermosensitive coloring layer coating liquid, Liquid CE, whereby a comparative thermosensitive recording material No. 3 was prepared.

Comparative Example 4

Liquid A, Liquid C, Liquid B and Liquid D prepared in Example 1 were mixed with a ratio by weight of 1:6:1:3, whereby a comparative thermo-sensitive coloring layer coating liquid, Liquid G, was prepared.

Liquid G was coated on a sheet of high quality paper having a basis weight of 52 g/cm$^2$, with a deposition of 4.0 to 7.5 g/m$^2$ when dried, whereby a thermosensitive coloring layer was formed on the high quality paper. The thermosensitive coloring layer was then subjected to calendering until the smoothness became 500 to 3000 seconds in terms of Bekk's smoothness, whereby a comparative thermosensitive recording material No. 4 was prepared.

Comparative Example 5

Comparative Example 4 was repeated except that Liquid C employed in Comparative Example 4 was replaced by Liquid CC prepared in Comparative Example 1, whereby a comparative thermosensitive recording material No. 5 was prepared.

The thus prepared thermosensitive recording materials No. 1 according to the present invention and the comparative thermosensitive recording materials Nos. 1 to 5 were subjected to thermal printing by use of a thermal printing test apparatus including a thermal head of a thin film type (made by Matsushita Electronic Components Co., Ltd.) under the conditions that the power applied to the head was 0.37 W/dot, the recording time per line was 5 msec, the scanning line density was 8×3.85 dots/mm, and the pulse width applied thereto was 1.0 msec.

The reflection ratios of the printed image and the background were measured by a commercially available spectrophotometer (Trademark "Hitachi 330 Type Spectrophotometer" made by Hitachi, Ltd.) with application of light having a wavelength of 900 nm.

Printed samples of the above recording materials were subjected to a heat resistant test by allowing each printed sample to stand at 60° C. and at normal room humidity for 24 hours. Thereafter, the reflection ratios of the printed image and the background of each sample were measured by the above spectrophotometer in the same manner as mentioned above.

Printed samples of the above recording materials were also subjected to a humidity resistant test by allowing each printed sample to stand at 40° C. and 90% RH for 24 hours. Thereafter, the reflection ratios of the printed image and the background of each sample were measured by the above spectrophotometer in the same manner as mentioned above.

Printed samples of the above recording materials were further subjected to a light resistant test by exposing each printed sample to the light of 5000 lux for 100 hours. Thereafter, the reflection ratios of the printed image and the background of each sample were measured by the above spectrophotometer in the same manner as mentioned above.

The results of the above tests are shown in Table 1.

TABLE 1

| | Initial Reflection Ratio (%) | | Reflection Ratio (%) after Heat Resistant Test (60° C., dry) | | Reflection Ratio (%) after Humidity Resistant Test (40° C., 90% RH) | | Reflection Ratio (%) after Light Resistant Test (5000 Lux) | | |
|---|---|---|---|---|---|---|---|---|---|
| | Image Area | Back-ground | Image Area | Back-ground | Image Area | Back-ground | Image Area | Back-ground | Developed Color Tone |
| Example 1 | 10.6 | 97.3 | 15.5 | 93.6 | 12.4 | 90.9 | 34.1 | 89.9 | Black |
| Comparative Example 1 | 11.0 | 97.4 | 58.4 | 95.0 | 45.7 | 92.4 | 87.4 | 90.2 | Black |
| Comparative Example 2 | 10.5 | 97.2 | 12.7 | 94.2 | 11.3 | 93.8 | 37.3 | 88.0 | Green |
| Comparative Example 3 | 10.1 | 97.8 | 46.1 | 96.0 | 40.7 | 94.5 | 92.7 | 89.4 | Green |
| Comparative Example 4 | 10.6 | 97.0 | 16.7 | 92.7 | 13.1 | 91.5 | 62.9 | 89.9 | Black |
| Comparative Example 5 | 12.4 | 96.2 | 59.6 | 94.4 | 47.2 | 91.8 | 94.9 | 90.4 | Black |

The above results indicate that the thermosensitive recording material according to the present invention can yield images with high density which absorb light having a wavelength of 900 nm. The obtained images are black in color with a colorless or light-colored background. The images and the background thereof are resistant to heat, high humidity and light. The thermosensitive recording material according to the present invention is much more resistant to heat, humidity and light than the comparative thermosensitive recording material in which the color developer in the first thermosensitive coloring layer is replaced by Bisphenol A as can be seen from Comparative Example 1. In contrast to the thermosensitive recording material in which the first and second thermosensitive coloring layers are provided on a support, which is capable of yielding black images when only a single thermosensitive coloring layer is formed on the support, the developed color tone is green as can be seen from Comparative Examples 3 and 4. Furthermore, the thermo-sensitive recording material according to the present invention is also more resistant to heat, humidity and light than the comparative thermosensitive recording materials in which the first leuco dye and the second leuco dye are mixed in a single thermosensitive coloring layer as can be seen from Comparative Examples 4 and 5.

What is claimed is:

1. A thermosensitive recording material comprising:

(a) a support material;

(b) a first thermosensitive coloring layer, which comprises a first colorless or light-colored leuco dye having formula (I),

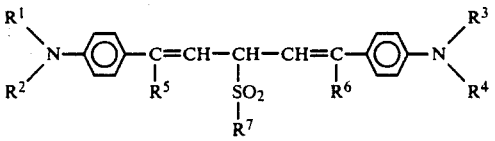

(I)

wherein $R^1$, $R^2$, $R^3$ and $R^4$ each represent hydrogen or an alkyl group having a substituent, $R^5$ and $R^6$ each represent hydrogen or a phenyl group which may have a substituent, and $R^7$ represents an alkyl group which may have a substituent or a phenyl group which may have a substituent, and a first color developer having formula (II) capable of inducing color formation in said first leuco dye upon application of heat thereto,

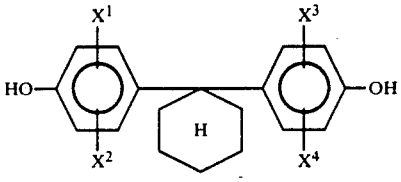

wherein $X^1$, $X^2$, $X^3$ and $X^4$ each represent hydrogen or an alkyl group having 1 to 4 carbon atoms, and (c) a second thermosensitive coloring layer which comprises at least a second leuco dye having formula (III),

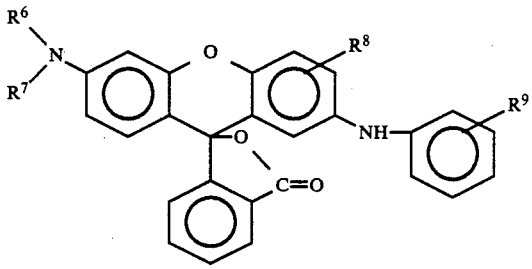

(III)

wherein $R^6$ and $R^7$ each represent a saturated or unsaturated hydrocarbon group having 1 to 10 carbon atoms, which may be in a cyclic or non-cyclic form and may include an ether bond therein, $R^8$ represents a hydrocarbon group having 1 to 2 carbon atoms, or halogen, and $R^9$ represents hydrogen, halogen, or a hydrocarbon group having 1 to 6 carbon atoms, and a second color developer capable inducing color formation in the second leuco dye upon application of heat thereto, said first and second thermosensitive coloring layers being formed in any order on said support.

2. The thermosensitive recording material as claimed in claim 1, wherein said first thermosensitive coloring layer and said second thermosensitive coloring layer are successively formed on said support.

3. The thermosensitive recording material as claimed in claim 1, wherein said first leuco dye is selected from the group consisting of:

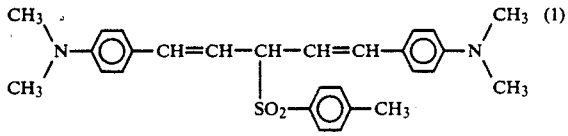

(1)

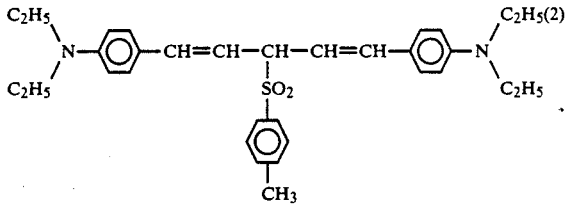

(2)

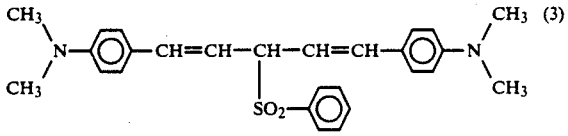

(3)

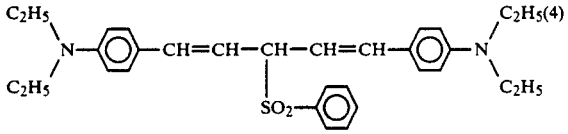

(4)

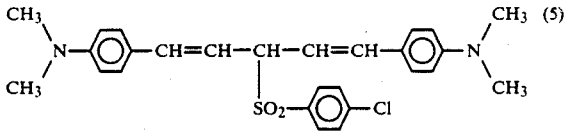

(5)

-continued
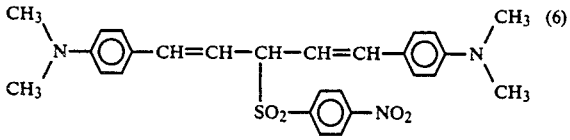
(6)
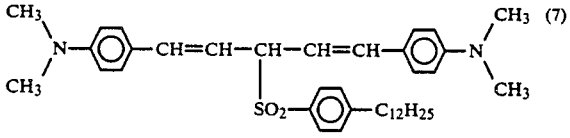
(7)
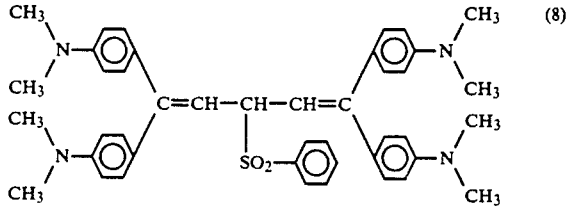
(8)
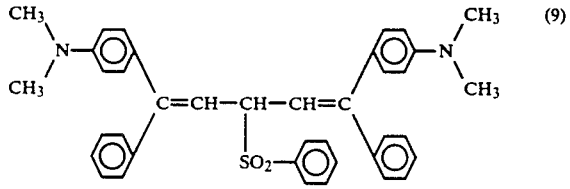
(9)
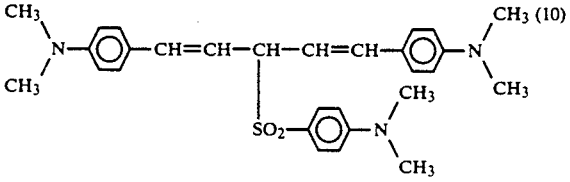
(10)
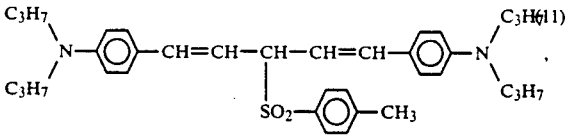
(11)
-continued
and
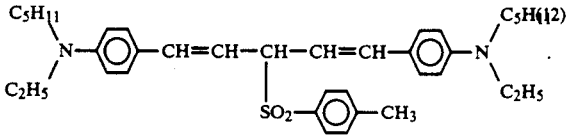
(12)
4. The thermosensitive recording material as claimed in claim 1, wherein said first color developer is selected from the group consisting of:
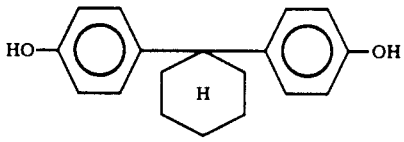
(1)
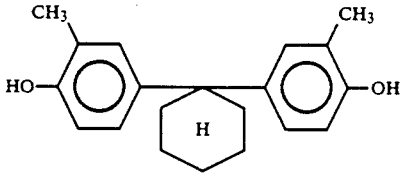
(2)
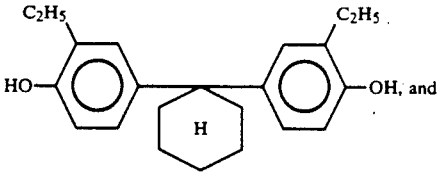
(3)
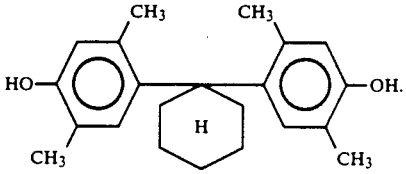
(4)
* * * * *

UNITED STATES PATENT AND TRADEMARK OFFICE

CERTIFICATE OF CORRECTION

PATENT NO. : 4,939,116

DATED : July 3, 1990

INVENTOR(S) : Takashi Ueda, et al.

It is certified that error appears in the above-identified patent and that said Letters Patent is hereby corrected as shown below:

At Column 1, Lines 16-17;"pressuresensitive" should read --pressure-sensitive--

At Column 2, Lines 28-29; "capable inducing" should read --capable of inducing--

At Column 2, Line 66; "capable inducing" should read --capable of inducing--

At Column 4, Line 7; "react this salt" should read --react to this salt--

At Column 9, Lines 9-10; "above mentioned" should read --above-mentioned--

At Column 10, Line 27; "N-cylohexyl" should read --N-cyclohexyl--

At Column 11, Line 13; "dispsersing" should read --dispersing--

At Column 11, Line 45; "thermo-sensitive" should read --thermosensitive--

UNITED STATES PATENT AND TRADEMARK OFFICE

CERTIFICATE OF CORRECTION

PATENT NO. : 4,939,116

DATED : July 3, 1990

INVENTOR(S) : Takashi Ueda, et al.

It is certified that error appears in the above-identified patent and that said Letters Patent is hereby corrected as shown below:

At Column 2, Line 54;

" 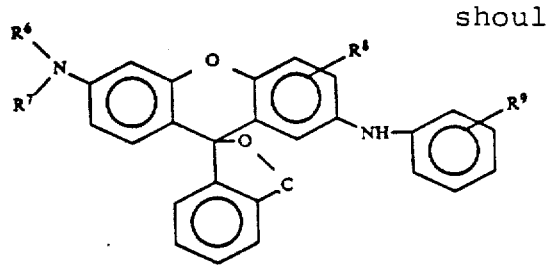

should read -- 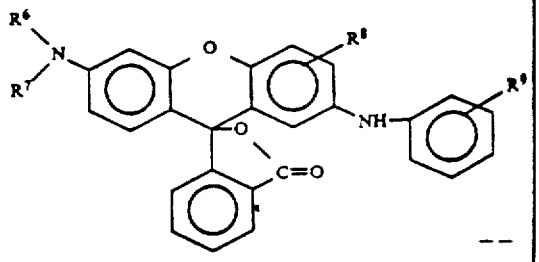 --

At Column 13, Line 21; "thermo-sensitive" should read --thermosensitive--

At Column 14, Lines 21-22; "capable inducing" should read --capable of inducing--

Signed and Sealed this

Fourteenth Day of July, 1992

*Attest:*

*Attesting Officer*

DOUGLAS B. COMER

*Acting Commissioner of Patents and Trademarks*